US005543020A

United States Patent [19]

Sitges Menendez et al.

[11] Patent Number: 5,543,020

[45] Date of Patent: Aug. 6, 1996

[54] CLEANING SYSTEM FOR ELECTROLYTIC TANKS

[75] Inventors: Francisco J. Sitges Menendez, Madrid; Fernando Sitges Menendez, Salinas; Francisco Alvarez Tamargo, Luanco; Ives Lefevre, Salinas, all of Spain

[73] Assignee: Asturiana De Zinc., S.A., Spain

[21] Appl. No.: 261,640

[22] Filed: Jun. 17, 1994

[30] Foreign Application Priority Data

Aug. 10, 1993 [ES] Spain ..... 9301778

[51] Int. Cl.[6] ..... C25B 15/00

[52] U.S. Cl. ..... 204/233; 204/269

[58] Field of Search ..... 204/269, 275, 204/276, 233

[56] References Cited

U.S. PATENT DOCUMENTS

| | | | |
|---|---|---|---|
| 2,514,283 | 9/1944 | Lawson | 204/245 |
| 3,708,415 | 10/1971 | Hubbard | 204/257 |
| 3,808,117 | 4/1974 | Spendlove | 204/234 |
| 4,182,671 | 1/1980 | Squarcialupi | 204/276 |
| 4,439,062 | 5/1984 | Kingsbury | 405/24 |
| 5,002,642 | 3/1991 | Kaneko | 204/105 R |

FOREIGN PATENT DOCUMENTS 2219805 1/1974 France .

*Primary Examiner*—John Niebling
*Assistant Examiner*—Brendan Mee
*Attorney, Agent, or Firm*—Ostrolenk, Faber, Gerb & Soffen, LLP

[57] ABSTRACT

A cleaning system for electrolytic tanks consisting of a cell with a preferably rectangular layout, very long relative to its width, and which is provided with at least one conduit with perforated walls, and preferably two, which run over the bottom of the cell, along its length, and ascend alongside the shorter walls until they reach, approximately, the level of liquid of the tank, said cell being provided below with surfaces which are inclined towards the perforated conduits, said conduits having sufficient cross-sectional area to act as guides through which are inserted a suction head and pipe for sludge extraction.

1 Claim, 2 Drawing Sheets

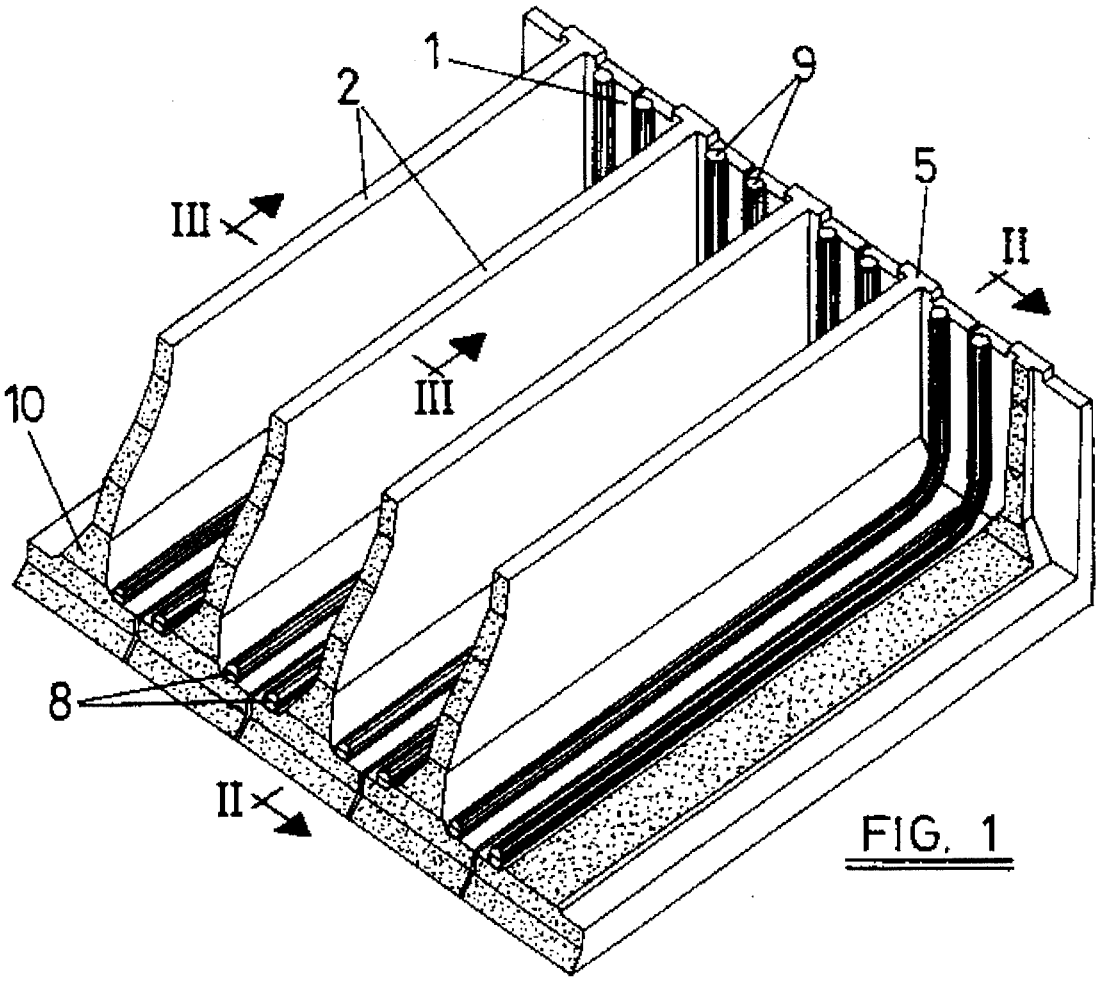
FIG. 1
FIG. 2
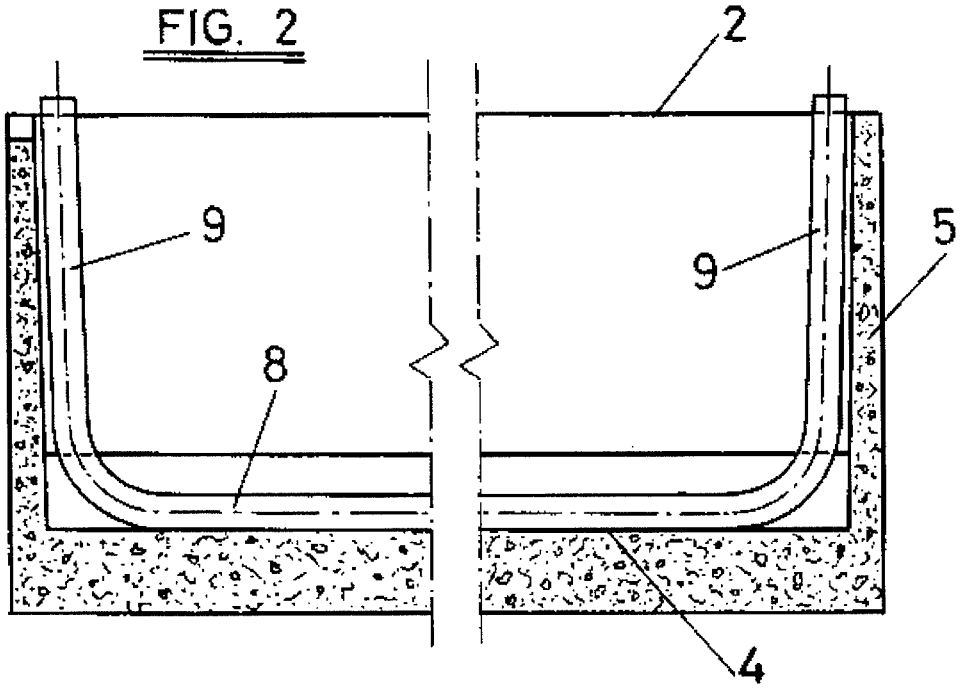

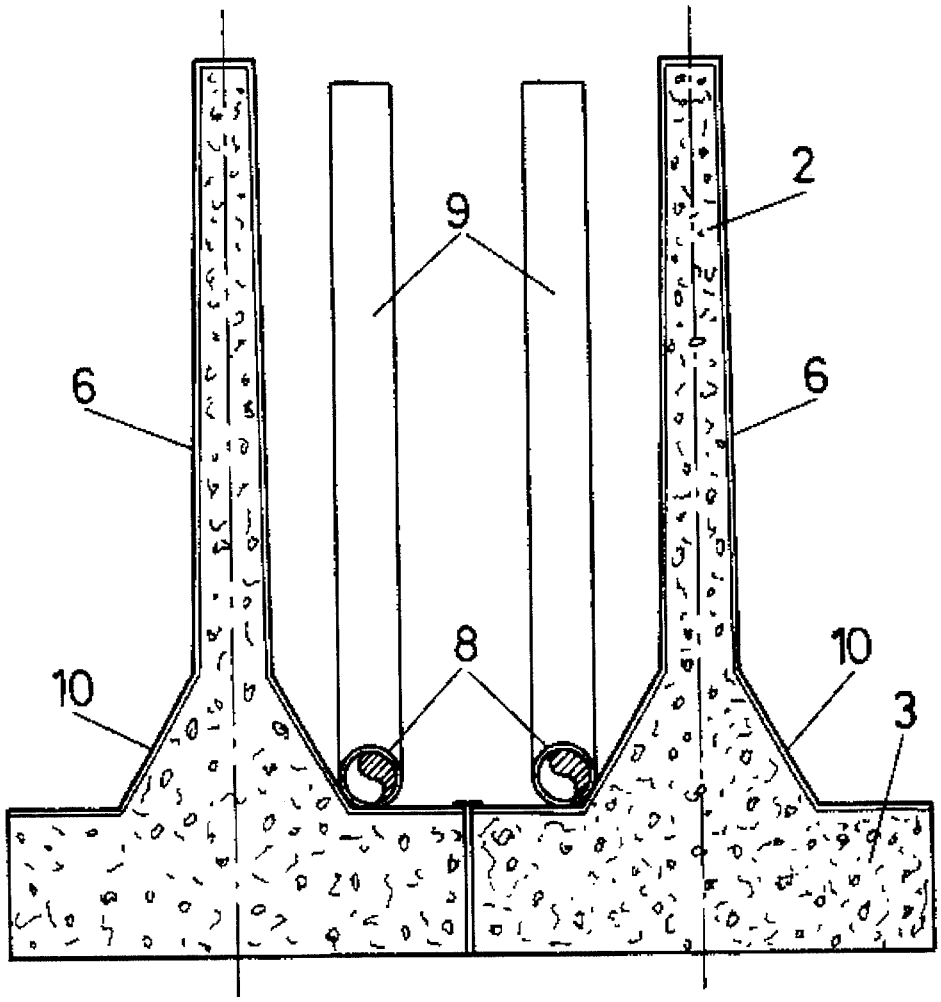
FIG. 3
FIG. 4
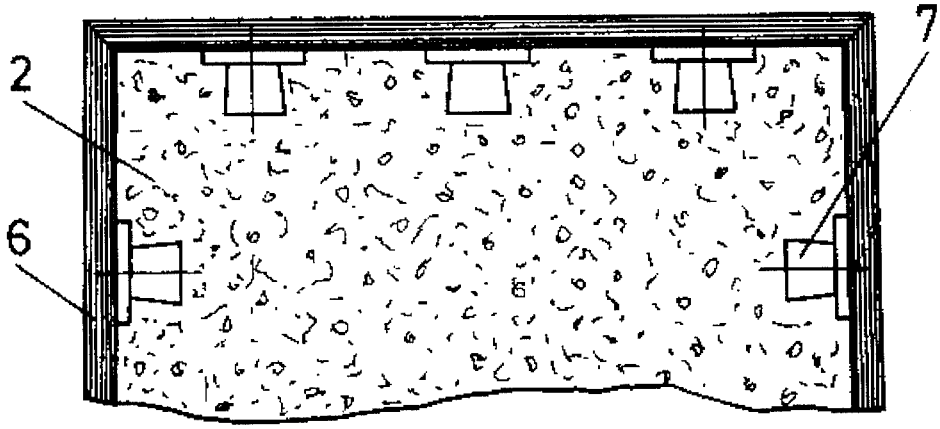

CLEANING SYSTEM FOR ELECTROLYTIC TANKS

BACKGROUND OF THE INVENTION

1. Field of the Invention

The present invention relates to a tank for electrolysis installations, in particular for installations for the electrolytic production of non-ferrous metals, such as zinc, copper, etc.

2. Description of the Related Art

Installations for the production of non-ferrous metals by electrolysis comprise a series of identical consecutive tanks separated by intermediate walls. Generally, the tanks have a rectangular layout, very long compared to the width, said width being determined by the width of the plates which constitute the cathodes and the anodes.

During the process of electrolysis, sludges are produced and deposited progressively partly on the abodes and partly at the bottom of the tanks and have to be removed periodically. In order to carry out the extraction of these sludges, the process of electrolysis has to be stopped, with the resulting effect on the productive process.

Some of the most widely used current procedures for extracting the sludges consist of using the main bridge to withdraw some of the anodes and cathodes, thereby creating an access opening, whilst others consist of short-circuiting one or a series of tanks and then removing the sludges, lifting the electrodes or not, either via the upper part with a suction tube or from below with a drainage tube at the bottom of the tank.

Then, the operators insert a rigid suction tube and sweep the bottom of the tank, thereby extracting the sludges. The electrodes are put back into place. Another opening is made a little further on and the process continues.

SUMMARY OF THE INVENTION

The present invention is a tank provided with means which enables the sludges to be removed without having to interrupt the normal operating process, such that it can be maintained continuously.

According to the present invention, each of the tanks of which the installation consists is provided with at least one conduit with perforated walls which runs over the bottom of the cell, along its length, and ascends alongside the shorter walls until it reaches, approximately, the level of liquid of said cell or higher. Preferably, each cell is provided with two conduits which run over the bottom and ascend alongside the shorter walls. In any case, the cell is provided below with surfaces which are inclined towards the tubes such that the sludges which are produced slide and are directed towards the perforated conduits.

The aim of these perforated conduits is to act as guides for inserting a suction head and pipe. Preferably, the pipe with a suction head is inserted through the ends of each tube such that the travel of said head through the tubes is limited to half the length of the tanks.

With the arrangement described, the sludges which fall onto the bottom of the tank slide towards the perforated conduits. When the suction pipe and head are inserted into a tube the liquid enters via the holes in the conduits, sweeping along the sludges which are thereby sucked up and extracted to the outside.

As the perforated tubes are installed permanently in the tanks, the cleaning of said tanks can be carried out at any time, without having to totally or partially stop the process of electrolysis.

BRIEF DESCRIPTION OF THE DRAWINGS

The characteristics of the present invention are described below in greater detail with reference to the accompanying drawings which show by way of a non-limiting example one practical embodiment thereof.

In the drawings:

FIG. 1 is a partial perspective view of an electrolysis installation consisting of a series of consecutive tanks with a rectangular layout and separated by intermediate walls.

FIG. 2 is a partial longitudinal section of a tank taken along the line II—II of FIG. 1.

FIG. 3 is a cross section of a tank taken along the line III—III of FIG. 1.

FIG. 4 is a vertical section of one of the longitudinal walls of the tanks.

DESCRIPTION OF THE PREFERRED EMBODIMENT

FIG. 1 represents an electrolysis installation designed for the electrolytic production of non-ferrous metals consisting of a series of identical consecutive tanks 1, with a rectangular layout, which are separated from each other by intermediate longitudinal walls 2. The tanks are preferably made of concrete, and may be formed of pre-fabricated modules 3 (FIG. 3) in the approximate shape of an inverted T, which constitute the bottom 4 and longitudinal walls 2 of the tanks, being closed transversely by means of transverse walls 5 (FIGS. 1 and 2) which may be continuous across the entire assembly of tanks 1. The inner surface of the tanks, defined by the longitudinal walls 2, transverse walls 5 and bottom 4, are coated with an electrically insulating, anti-corrosive barrier made of a plastic material.

Until now this coating was obtained by applying a PVC, FRP or lead-based laminar coating to the inner surfaces of the concrete walls and bottom. During the cleaning of the tanks, or due to accidental blows produced during the handling of the electrodes, the laminar coating was eroded or ripped until it lost its watertightness.

This problem is avoided by using a special plastic sheet which is applied to the surface of the formwork used for concreting the components of the tanks 1. The plastic sheet used is provided on its free surface with precise anchorings which are sealed inside the mass of concrete. When the formwork is removed from the components, the plastic coating is left fixed to the pieces of concrete by means of the precise anchorings.

FIG. 4 represents a vertical section of the longitudinal wall which separates consecutive tanks 1 and shows the coating layer 6, made of a plastic material, provided on its inner surface with anchorings 7 which are fixed to the mass of concrete of the wall 2. The different joints which may exist in this layer 6 are made in such a way that perfect joints and watertightness are obtained.

As can be seen in FIGS. 1, 2 and 3 two conduits 8 with perforated walls run longitudinally over the bottom 4 of each tank and ascend alongside the transverse walls in the form of sections 9 which reach, approximately, the level of liquid in the tank. The longitudinal walls have lower sections 10 which are inclined towards the conduits 8 with perforated walls. Through the ends of the ascending sections 9 are inserted a suction head and pipe, by means of which the sludges are extracted, being swept along towards the inside of the conduits 8 by the current of liquid sucked in, through the holes in the walls.

The purpose of the lower inclined sections 10 of the tank walls is to convey the sludges which are sedimented towards the conduits 8. These conduits have perforated walls, such that as the suction head moves inside them, a current of liquid is created from the outside to the inside of the conduits and is capable of sweeping the sludges along.

The arrangement of the perforated guide tubes enables the work of cleaning the tanks to be carried out from lateral walkways, either manually, semi-automatically or automatically, without interfering with the other operating sequences of the electrolysis bay. Furthermore, it enables the sludges to be removed without the operators having to work over the tanks during said operation, but rather in a region where the ambient air quality conforms to the standards in force.

In short, the arrangement of the tubes described enables the cleaning of the tanks to be carried out without having to stop the process and without interfering with other operations taking place in the installation, all of which implies an increase in the deposition yield and a reduction in operating costs.

We claim:

1. An electrolysis installation comprising (a) a tank for electrolysis including cells, each cell having a rectangular layout, with a length, a width shorter than the length, and a depth, a closed bottom and side walls, and an open top having an upper edge, each cell being provided along the upper edge of its longer walls with electrical outlets for the electrodes as well as insulating supports for the electrodes, the tank comprising at least one conduit with perforated walls in each cell, which conduit runs over the bottom of the cell, along its length, and ascends alongside the shorter walls to reach a level for liquid within the tank, the cell being provided below with surfaces which are inclined towards at least one perforated conduit, the conduit having sufficient cross-sectional area to act as a guide for insertion of a suction head and pipe for sludge extraction; and (b) a suction head and pipe for sludge extraction adapted to be inserted into said conduit.

* * * * *